United States Patent [19]

Wilbur

[11] 4,363,081

[45] Dec. 7, 1982

[54] ILLUMINATED GREETING CARDS

[76] Inventor: Robert W. Wilbur, 30 N. Byron Ave., Brockton, Mass. 02401

[21] Appl. No.: 164,505

[22] Filed: Jul. 2, 1980

[51] Int. Cl.[3] ..... B42D 15/04; G09F 1/04

[52] U.S. Cl. ..... 362/98; 46/35; 46/36; 40/124.1; 40/442; 362/155; 362/251; 362/252; 362/253; 362/808; 362/800; 362/802; 362/806

[58] Field of Search ..... 362/98, 99, 155, 800, 362/802, 253, 806, 808, 251, 252; 40/124.1, 442, 445; 46/35, 36, 37

[56] References Cited

U.S. PATENT DOCUMENTS

| | | | |
|---|---|---|---|
| 928,744 | 7/1909 | Fisher | 362/124 |
| 1,202,498 | 10/1916 | Findley | 362/99 |
| 1,938,538 | 12/1933 | Henninger, Jr. | 362/124 |
| 2,633,668 | 4/1953 | Schaefer | 362/802 |
| 3,364,344 | 1/1968 | Marcellimo | 362/802 |
| 4,209,824 | 6/1980 | Kaufman | 362/98 |
| 4,215,388 | 7/1980 | Reimann | 362/800 |
| 4,231,079 | 10/1980 | Heminover | 362/800 |

FOREIGN PATENT DOCUMENTS

| | | | |
|---|---|---|---|
| 179664 | 10/1917 | Canada | 362/98 |

*Primary Examiner*—Teddy S. Gron
*Attorney, Agent, or Firm*—Cesari and McKenna

[57] ABSTRACT

An electrically illuminated folded card device formed from sheet stock, for use as a greeting card or the like. A first portion of the sheet stock forms a display panel having one or more apertures. LED's disposed behind the display panel provide illumination through the apertures. A printed circuit board is mounted behind the display panel; LED's are, in turn, mounted on the board. A portion of the sheet stock forms a tab disposed behind the display region. A slide switch is formed by a pair of conductive foil areas on the printed circuit board and a conductive shorting member is attached to the tab. As the card is opened, the tab translates behind the display panel and the shorting member wipes across the pair of foil areas, to complete the circuit between the battery and lamps, to turn on the LED's.

10 Claims, 12 Drawing Figures

ILLUMINATED GREETING CARDS

FIELD OF THE INVENTION

This invention relates to the field of greeting cards and displays made of folded cardboard or other sheet stock. More particularly, the invention relates to illuminated greeting cards and displays for advertising or similar purposes and for novelty itmes.

BACKGROUND OF THE INVENTION

Illuminated greeting cards, ornaments, etc. have heretofore been proposed, but they have been either too bulky, too heavy, or too expensive to manufacture. Therefore, they have not been commercially successful. For example, U.S. Pat. No. 3,740,543 issued June 19, 1973 to Charles Franc shows a portable, battery operated illuminated ornament for use on greeting cards, gift packages and the like. But that invention requires a battery with at least one costly, specially manufactured terminal. Moreover, due to the dimensions necessary for such terminal (which must contain an aperture for receiving the base of a bulb), the greeting card will be quite bulky. In addition, the switch employed in the illuminating circuit is not designed for inexpensive manufacture or to have other useful and advantageous characteristics.

SUMMARY OF THE INVENTION

Accordingly, it is an object of the present invention to provide an illuminated device for use as a greeting card, novelty item, gift package, advertising display, or the like, which is simple in design, easy and inexpensive to manufacture, rugged, efficient and reliable in operation.

It is a further object of the invention to provide an illuminated device formed of folded sheet stock wherein at least one of the members of a switch for the illumination circuit is attached to the sheet stock, such that the opening of the device along a fold of the sheet stock causes the closing of the switch and the closing of the device causes the opening of the switch.

Other objects and features of the present invention will become apparent from the following description, which should be read in connection with the accompanying drawings. It is to be understood, however, that this description and the drawings are intended for the purpose of illustration only and not as a definition of the limits or scope of the invention. The scope of the invention is intended to be limited only as set forth in the claims appended at the end of the description.

In accordance with the foregoing objects, the present invention provides a folded card formed from sheet stock, such as cardboard. A first portion or panel of the sheet stock forms a display region having one or more apertures through which illumination may be provided. Illumination means (preferably light-emitting diodes, i.e., LED's or miniature incandescent bulbs) are disposed behind such apertures. Also disposed behind the display region of the sheet stock are a flat battery, a printed circuit board and a switch. The illumination means, switch and battery are wired in series or series-parallel. All wiring is done on the printed circuit board. The display panel of the sheet stock is joined along a fold to a second panel, one surface of which faces the display panel. The opening of the card to expose the display panel closes the switch and turns on the illumination, and vice-versa.

The illumination source may be visible directly through the aperture(s) or the aperture(s) may be covered with a transparent or translucent film to be illuminated from the rear by the light source. The film may, for example, be a conventional photographic slide transparency which is lighted for viewing by opening the card.

Two embodiments of a suitable motion-actuated switch are shown. In both, a portion of the sheet stock comprising a tab extends from the front cover of the card into the rear cover of the card, behind the display panel. The difference between the two is the manner in which the tab is constructed. The opening and closing of the card translates such tab along the back side of the display panel. The tab carries the moveable member of a slide switch, the other member of the switch comprises a pair of stationary, normally open contacts comprising conductive areas on the printed circuit board which in turn, is fastened to the back of the display panel. When the card is opened, the moveable member wipes against and, thus, "shorts out" the stationary contacts, closing the switch. Conversely, when the card is closed, the moveable member is slid away from the stationary contacts, opening the switch.

In various alternative embodiments, additional elements are added to the display device, including a flasher for blinking lamps on and off, a tone generator and acoustic transducer for providing audible signals and a solenoid for providing motion.

DESCRIPTION OF ILLUSTRATIVE EMBODIMENTS

Figure 1:
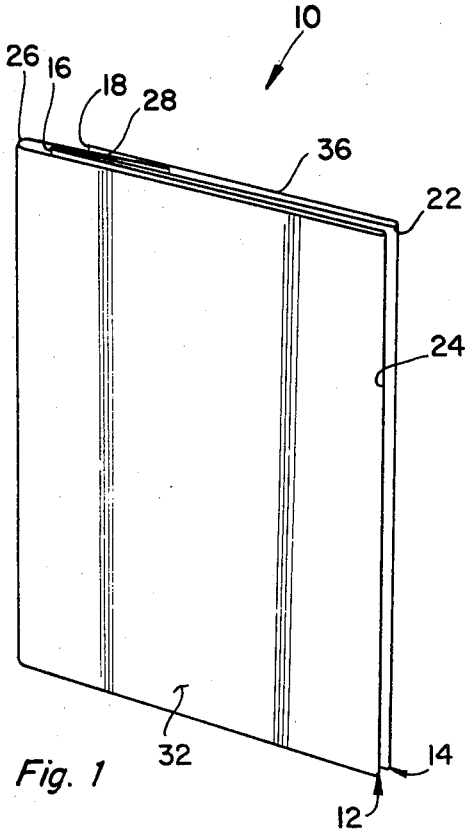
FIG. 1 is an isometric front view of a first embodiment for a greeting card or like device, according to the present invention, showing the card in the closed position.
Figure 3:
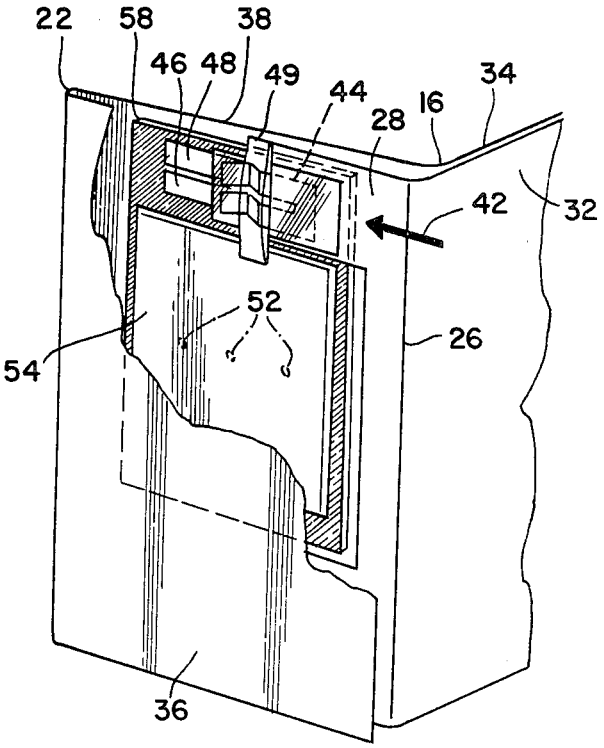
FIG. 3 is a partially cut away isometric rear view of the card of FIGS. 1 and 2, in the open position.
Figure 2:
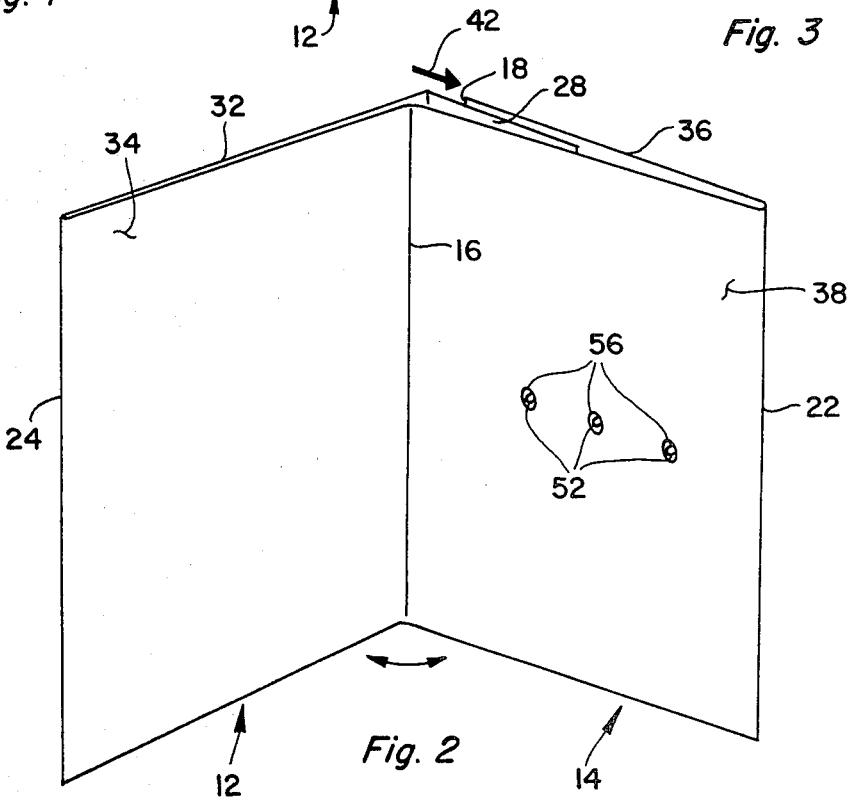
FIG. 2 is an isometric front view of the card of FIG. 1, showing the card in the open position.

A first embodiment of the invention is illustrated in FIGS. 1–3, in the form of a greeting card. In FIG. 1, the greeting card is shown in its closed position, from a front isometric view. The greeting card 10 comprises a front cover section 12 and a rear cover section 14 hinged about a fold 16. In folding the sheet stock to form the card, at least one another, and sometimes several, folds are made. Proceeding from rear edge 18 of the sheet stock, the first fold 22 is made to form the rear cover 14. A second fold, 16 provides the hinge between the front and rear sections of the card. Hinge 16 is folded in the opposite direction from fold 22. Opposite fold 22, an outwardly directed, reverse fold 24 is made, to form the outside part of front cover 12. A short distance past fold 16, the sheet stock is again folded at 26, toward the rear of the card; and the remainder 28 of the sheet, from fold 26 to the second free end thereof, forms a tab which is wrapped behind fold 16 but in front of rear edge 18 of the opposite end of the sheet stock.

The card thus formed has an outside front cover 32, an inside front cover 34, an outside rear cover 36 and an inside rear cover 38. As illustrated in FIG. 2, when the card is opened about fold 16, tab portion 28 is translated along the back of the inside rear cover 38 toward the fold 22, as indicated by the arrow 42. Conversely, closing the card translates tab portion 28 in the opposite direction.

As indicated in FIG. 3, which shows a rear view of the card of FIGS. 1 and 2, tab portion 28 carries thereon a translatable (i.e., slideable) conductive switch member or contact-closing wiper element 44 which, when the card is opened, short circuits a pair of stationary contact terminals 46 and 48. Switch member 44 is a basically U-shaped piece of sheet metal the legs of which are bent so as to form knees which wipe against the contact terminals 46 and 48 when the card is opened. The closing of the switch contacts 46 and 48 by shorting member 44 completes an electrical circuit and illuminates one or more light emitting diodes (LED's) or lamps indicated at 52. The lamps 52 are positioned behind apertures 56 in surface 38 so that they may be seen therethrough.

Tab 28, which carries wiper contact 44, is restrained by an insulating strap 27. Strap 57 guides tab 28 and prevents wiper 44 from lifting off of the underlying surface.

Contacts 46 and 48 may, for example, be mounted on an insulating substrate 58, such as a printed circuit board. Indeed, the terminals 46 and 48 may simply comprise broad rectangular conductive foil traces on the printed circuit board; the lamps 52 may be mounted on the opposite side of the board and a flat battery 54 fastened to the same side of the PC board as the contact terminals 46 and 48. All necessary wiring may be formed directly on the printed circuit board.

Alternatively, the wiring and stationary switch contacts 46 and 48 may be formed of conductive tape or conductive ink applied directly to the sheet stock. The lamps then could be attached with an overlying conductive tape having a conductive adhesive.

The arrangement of folds shown in FIGS. 1–3 is not part of the present invention, having been developed earlier by persons unknown. In the past that arrangement has been used to produce lateral motion of an object against the display panel. That is, a horizontal slit was made in the display region and a portion of the tab (e.g., resembling an arrow or a ball) was inserted therethrough, so that it traversed the display region responsive to the opening or closing of the card.

Figure 4:
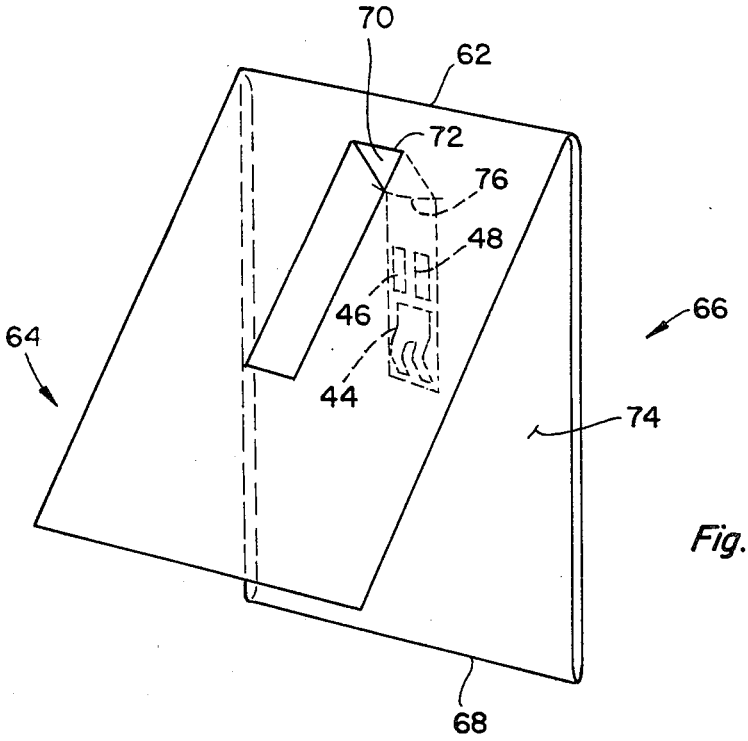
FIG. 4 is an isometric front view of a second embodiment for a greeting card or like device, according to the present invention, in a partially open position.

Turning now to FIG. 4, there is shown a second embodiment for a greeting card according to the present invention.

In that embodiment, the cardboard sheet stock is folded twice, approximately into three equal portions, each a third of the length of the sheet. A first fold 62 provides a hinge between the front section 64 and rear section 66, so that the first third of the stock constitutes a front cover or panel to the card. The third of the sheet at the other end of the stock is folded inwardly toward the middle of the card along a second fold 68, to form the display panel of the card. The middle third forms the rear cover of the card. An elongate rectangular tab 70 is cut from the front panel 64 along three sides, remaining hinged to the first third of the sheet stock along a line 72 parallel to fold 62. A slit 76 is made in display panel 74 parallel to line 72 to receive the tab 70. As shown in phantom, the moveable switch wiper element 44 is fastened to tab 70 for vertical translation. Stationary swtich contacts 46 and 48 are shown in phantom to illustrate their relationship to slide member 44.

The cutting of the front cover section 64 to form tab 70 leaves a rectangular hole in the front cover, allowing a view of the underlying portion of the display region and the upper portion of the tab. The artwork of the cover and display panel can take advantage of this arrangement in numerous ways. For example, tab 70 can be made to resemble the fluid in a thermometer, with the temperature rising as the card is opened and the "fluid" rises. Alternatively, of course, if it is desired to avoid the hole in the front panel, a tab of a separate piece of material may be glued to the inside of the cover.

Figure 5A:
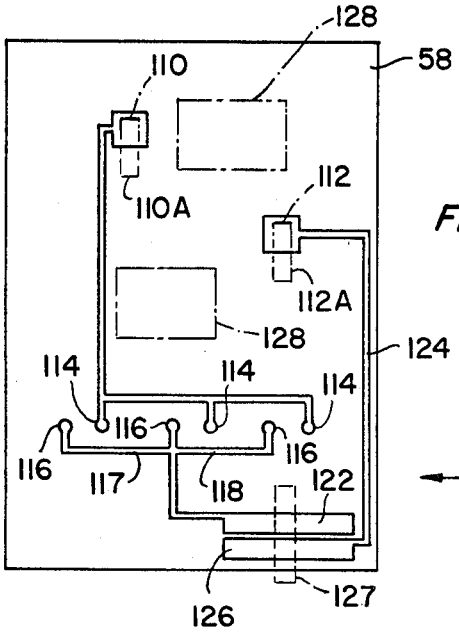
FIG. 5A is a rear elevational view of a printed circuit board for a basic form of the invention.

The simplest form of printed circuit board (or other "printed" conductive tracing) arrangement for use with either embodiment is illustrated in FIG. 5A. On what amounts to the rear side of the board, which faces the outside rear cover portion 36 of the sheet stock, there are a pair of battery contacts 110 and 112, foil traces providing conducting paths between first battery terminal 110 and one or more lead connection pads 114 to which a first terminal of a lamp, such as a LED may be connected. Corresponding conductive pads 116 are provided for the other terminal of each of the lamps. Pads 116 are connected together by conductive foil traces 118, in parallel, and thence to a first switch terminal 122. Second battery contact 112 is connected via a conductive foil trace 124 to a second switch contact 126. Switch contacts 122 and 126 are elongate, rectangular-shaped conductive sections arranged parallel and slightly separated from each other. The lamps are illuminated by causing a short circuit between contacts 122 and 126 as, for example, by the wiper element 44 shown in FIG. 3.

The lamps (i.e., LED's) are mounted onto the underside of the printed circuit board, so that their leads would extend through the board to the side shown in FIG. 5A. A flat battery (covered by an insulating material except in the area adjacent its terminals) is secured against the printed circuit board so that the battery terminals are brought into contact with pads 110 and 112. Optionally, it may be desirable to mount some type of springy contact element to pads 110 and 112, as indicated at 110A and 112A, respectively, to enhance the connection to the battery contacts. The battery may be secured, for example, by taping it to the printed circuit board or holding it in place by clips. In the drawing, double-sided adhesive tape 128 is placed on the printed circuit board to hold the battery. A suitable flat battery is the POLAPULSE P-100 battery manufactured by Polaroid Corporation, Cambridge, Mass.

Figure 5B:
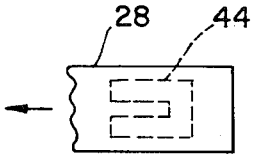
FIG. 5B is a rear elevational view of the moveable slide switch member of a slide switch for use in the present invention.
Figure 5C:
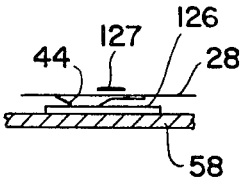
FIG. 5C is a top view of the moveable slide switch member of FIG. 5B showing the electrical contact thereof wiping against a foil trace on the printed circuit board of FIG. 5A.

The short-circuiting slider or wiper element 44 used for closing contacts 122 and 126 is illustrated in FIG. 5B, mounted on the tab 28, with a side elevational view shown in FIG. 5C.

Several interesting variations on the foregoing design also come to mind. For example, instead of just having a single pair of normally open switch contacts, with all lamps wired in parallel, two or more pairs of contacts (perhaps with one common contact) may be provided, so that the wiper 44 slides across (and shorts) these pairs in sequence as the card is opened thus permitting individual lamps or groups of lamps to be turned on in succession. Similarly, the switch(es) may be arranged as a rotary slide switch(es) and the front panel of the card can pull a string as it opens, to rotate the wiper(s).

Figure 6:
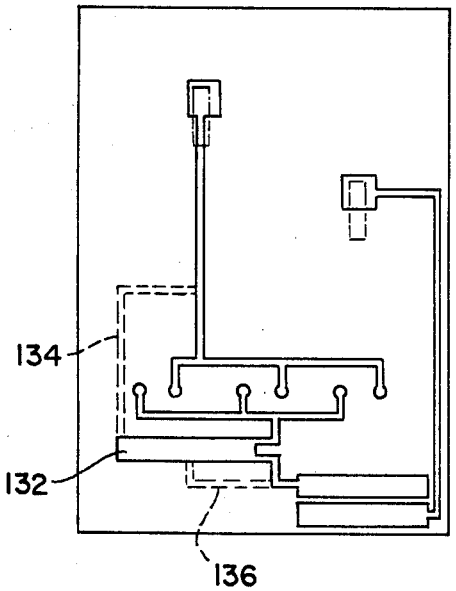
FIG. 6 is a rear elevational view of a printed circuit board for a first optional variation of the invention.

In FIG. 6, a flasher element 132 has been added in series with the battery, switch and lamps. Alternatively, the flasher may have to be separately powered in parallel with the lamp illumination circuit, in which event the dashed foil traces 134 and 136 would be added.

Figure 7:
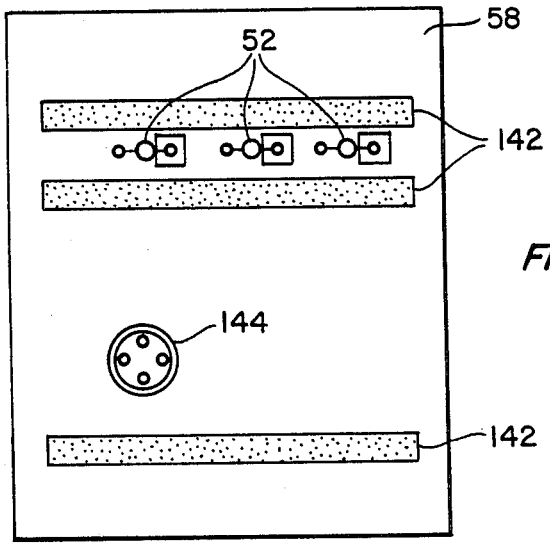
FIG. 7 is a front elevational view of a printed circuit board for a second optional variation of the invention.

In FIG. 7, the front side of the printed circuit board, such as the one shown in FIG. 5A, is illustrated. This front side is the side which faces inside rear cover portion 38 of the sheet stock. For securing the printed circuit board to the cardboard stock, three strips of a double-sidedadhesive material 142 have been provided thereon. Also, an optional acoustic transducer or beeper 144 is shown mounted to the printed circuit board, to provide an audio tone or beep when the switch is closed and the LED's are lit. The transducer 144 is simply wired in parallel with the LED's.

Figure 8:
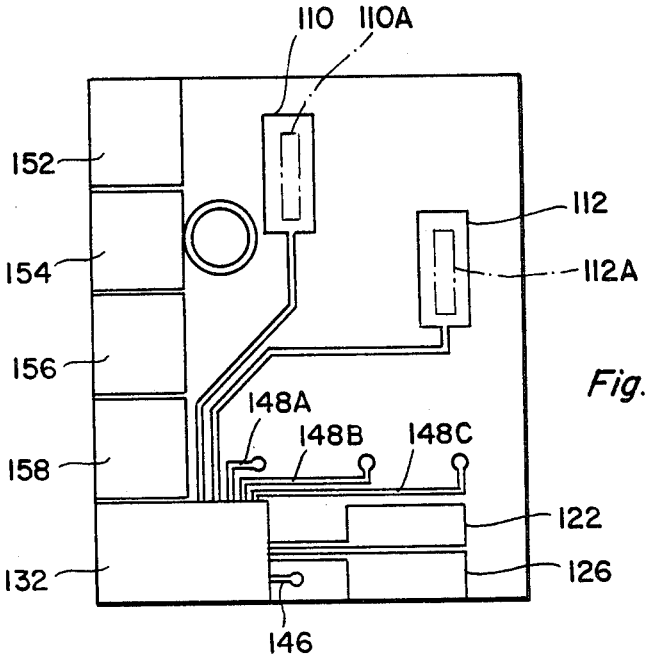
FIG. 8 is a rear elevational view of a printed circuit board for a third optional variation of the invention.

An even more elaborate arrangement is shown in FIG. 8, which illustrates the rear side of a printed circuit board having various optional features. In this embodiment, operation of the lamps is controlled by a flasher circuit 132, to which the battery, lamps and switch are connected. For simplicity of illustration, a common terminal of the lamps may be connected to a single conductor 146, with the other terminal of each of the lamps separately connected to the flasher by conductors 148*a*, 148*b* and 148*c*. The flasher 132 may flash the lamps in unison, or in some prearranged sequence.

Also shown is a tone generator module 152, a tone sequence memory 154, an oscillator and countdown circuit 156, and a timing generator 158. The timing generator 158 provides clocks to drive an oscillator and countdown circuit 156 to provide, in turn, control signals to tone generator circuit 152 and tone sequence memory 154. Responsive to the signals from block 156, the tone sequence memory and tone generator cooperate to provide a sequence of tones in a preselected order to play a tune through audio transducer 144. Thus, when the card is opened and switch contacts 122 and 126 are shorted together, the preselected tune, such as "Happy Birthday", will be played through the transducer. In addition, the lamps will be flashed.

As a simpler alternative for playing a tune, the sequence generator, oscillator and timing generator may be dispensed with. A tone generator 152, providing, for example four or five notes, may be connected to the transducer directly, with a touch-activated switch provided for annunciating each note.

In yet a further variation on the foregoing alternative, the words of the song to be played, such as Happy Birthday, may be printed on a portion of the card and a switch provided beneath each syllable. The appropriate note is established by the tone generator responsive to the closing of each switch. Thus, as finger pressure is applied against the card, and the finger is run across the card under each word, the indicated song is played.

Figure 9B:
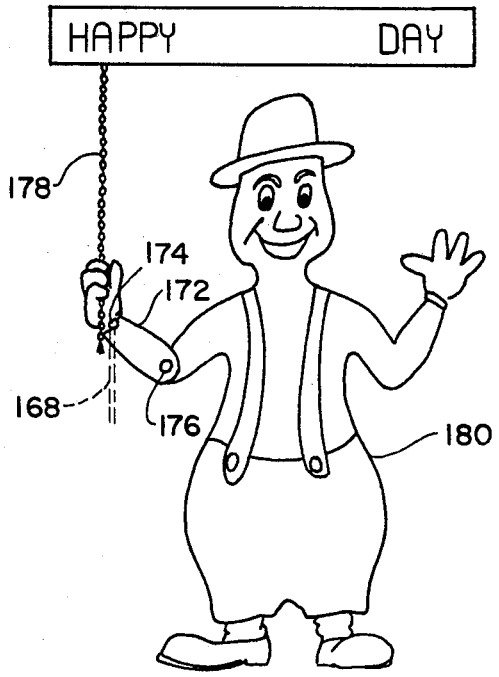
FIG. 9B is a pictorial illustration showing how the solenoid of FIG. 9A can be used to simulate manual actuation of an illumination-producing switch.
Figure 9A:
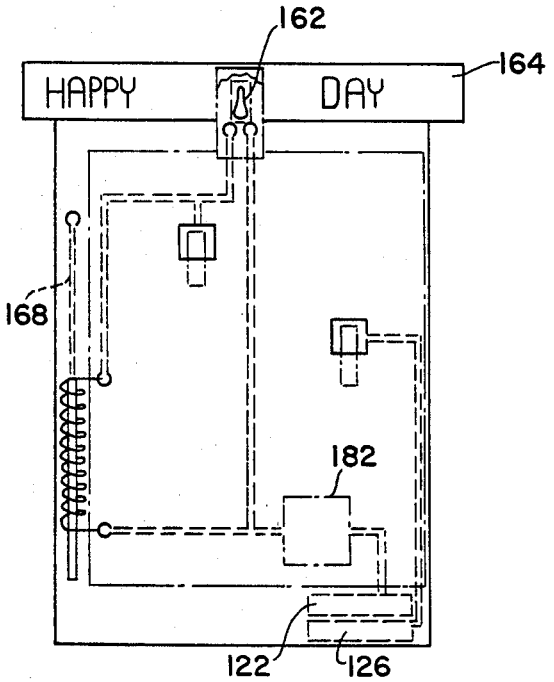
FIG. 9A is a front elevational view of a printed circuit board for a fourth optional variation of the invention, showing the use of a solenoid as a motion producer.

Another electrification option is illustrated in FIGS. 9A and 9B. This option has two features. First, one or more lamps 162 (which probably should be incandescent) are placed behind a piece of transparent or translucent plastic film, to provide rear illumination. The plastic may, in turn, have a message printed thereon and the inside rear surface 38 of the card would have a suitably covered aperature to display the message printed on the plastic. Second, a small solenoid 166 may be wired in parallel with the lamp 162. Through a slot cut in card surface 38, the solenoid plunger 168 may extend into the interior, i.e., display region of the card. There, it may be connected to a moveable element to effectuate motion, responsive to the actuation of the solenoid. For example, as illustrated in FIG. 9B, plunger 168 may be pivotally connected to an arm 172 at a point 174. Arm 172 may be secured to the card at a fixed pivot 176. Actuation of the solenoid then causes the hand adjacent pivot 174 to appear to be yanking on a chain 178. In synchronism with this motion, of course, the lamp 162 is illuminated. Thus, it is made to appear that the Figure is pulling the chain to turn on the lamp. An optional flasher 182 is shown in FIG. 9A, so that the arm 172 may "pull" the chain periodically, blinking the lamp on. It should be understood, though it has not been shown, that the card would include brasing means on the plunger 168 to restore it to its extended position. Also, although not shown, a metallic flasher element or a switch triggered by the solenoid should be employed in the solenoid actuator circuit, to open that circuit after the solenoid has been energized to avoid overheating of the solenoid and draining of the battery.

Having thus described a preferred embodiment and various alternative embodiments and optional features of the present invention, it is apparent that various alternatives, modifications and alterations thereto will readily occur to those familiar with the art, without departing from the spirit and scope of the invention. Accordingly, it is intended that all such obvious modifications, alterations, and improvements are part of this invention and that the invention is limited only as defined in the following claims.

I claim:

1. An illuminated card comprising:

a lamp for providing illumination;

a substantially flat battery for energizing the lamp;

a slide switch for closing a circuit to illuminate the lamp, the slide switch comprising a first, stationary member and a second moveable member;

a card formed of folded sheet stock;

the card having a first fold, defining first and second portions of the card on respective sides of the fold, such that the first and second portions of the card are hingeably connected to each other about the first fold;

the first and second portions of the card having first (i.e., inside) surfaces which face each other when the card is closed about said first fold;

the moveable switch member being fixed to the first card portion, so that the moveable switch member is translated across the second (i.e., outside) surface of the second portion of the card responsive to motion of the first card portion;

the stationary switch member also being disposed adjacent and fixed with respect to the outside surface of the second portion of the card;

the moveable and stationary switch members being disposed relative to each other such that they are caused to come into contact by the opening of the card and are separated from each other by the closing of the card;

the card having a second fold, defining a third portion of the card;

the third portion of the card forming a tab hingebly attached to the first portion of the card along said second fold;

at least part of the tab being disposed behind the inside surface of the second portion of the card and confined to translate across such surface responsive to the opening and closing of the card about the first fold;

the moveable switch member being attached to the tab; and the second portion of the card being provided with an aperture and the lamp being positioned behind such aperture, whereby the illumination of the lamp may be viewed there through when the card is opened.

2. The illuminated card of claim 1, further comprising:

the second portion having a slit therein disposed parallel to the first fold;

the third portion of the card being inserted through the slit from the inside of the second portion, so that a free end of the tab is adjacent the outside surface of the second portion.

3. The illuminated card of either of claim 1 or 2, wherein the stationary switch member comprises a pair of normally open contacts and the moveable switch member comprises a conductive wiper for shorting (i.e., closing) the normally open, stationary contacts.

4. The illuminated card of claim 3 further including a plurality of stationary switch members, each of which comprises a pair of normally open contacts, and the moveable switch member comprises a conductive wiper for shorting (i.e., closing) the normally open, stationary contacts; the pairs of normally open contacts being disposed so as to be shorted in sequence by the conductive wiper as the card is opened.

5. The illuminated card of claim 3 wherein the normally open, stationary contacts comprise flat conductive areas disposed on a flat substrate.

6. The illuminated card of claim 5 wherein the flat conductive areas comprise areas of conductive ink.

7. The illuminated card of claim 6 wherein the substrate is the sheet stock.

8. The illuminated card of either of claim 1 or 2, further including means for flashing the illumination means off and on.

9. The illuminated card of either of claim 1 or 2, further including means for producing an audible signal upon opening the card.

10. The illuminated card of either of claim 1 or 2, further including a solenoid actuable by the opening of the card and adapted to produce motion.

* * * * *